US008141530B2

(12) United States Patent
Ishikawa

(10) Patent No.: US 8,141,530 B2
(45) Date of Patent: Mar. 27, 2012

(54) ROCKER ARM

(75) Inventor: Shizuo Ishikawa, Nishio (JP)

(73) Assignee: Otics Corporation, Aichi (JP)

( * ) Notice: Subject to any disclaimer, the term of this patent is extended or adjusted under 35 U.S.C. 154(b) by 208 days.

(21) Appl. No.: 12/499,265

(22) Filed: Jul. 8, 2009

(65) Prior Publication Data

US 2010/0006046 A1 Jan. 14, 2010

(30) Foreign Application Priority Data

Jul. 10, 2008 (JP) ..... 2008-180453

(51) Int. Cl.
*F01M 1/06* (2006.01)

(52) U.S. Cl. ..... 123/90.33; 123/90.44

(58) Field of Classification Search ..... 123/90.33, 123/90.36, 90.39, 90.44, 90.45, 90.46; 74/559; 29/888.2
See application file for complete search history.

(56) References Cited

U.S. PATENT DOCUMENTS

| | | | | |
|---|---|---|---|---|
| 2,523,489 A | | 9/1950 | Winter, Jr. | |
| 2,572,968 A | * | 10/1951 | Bachle | 123/90.38 |
| 3,314,404 A | * | 4/1967 | Thompson | 123/90.43 |
| 3,400,696 A | * | 9/1968 | Thompson | 123/90.27 |
| 5,657,726 A | * | 8/1997 | Diggs | 123/90.36 |
| 6,070,561 A | * | 6/2000 | Greene et al. | 123/90.36 |
| 2009/0126665 A1 | * | 5/2009 | Edgar | 123/90.39 |

FOREIGN PATENT DOCUMENTS

| | | |
|---|---|---|
| DE | 196 45 789 | 5/1998 |
| JP | 2001-317311 | 11/2001 |
| JP | 2001317311 A * | 11/2001 |
| JP | 2007-056690 | 3/2007 |

OTHER PUBLICATIONS

European Search Report dated Sep. 9, 2009 in corresponding European Application No. 09008921.0.

* cited by examiner

*Primary Examiner* — Thomas Denion
*Assistant Examiner* — Daniel Bernstein
(74) *Attorney, Agent, or Firm* — Wenderoth, Lind & Ponack, L.L.P.

(57) ABSTRACT

A rocker arm configured to be supported by a support portion of an internal-combustion engine and to be driven in a swinging manner by a cam. The rocker arm includes a rocker arm body including a cam follower having a first slide-contact surface, wherein the first slide-contact surface is in sliding contact with the cam, a fulcrum portion including a second slide-contact surface, wherein the second slide-contact surface swingably is in sliding contact with respect to the support portion, and a lubricant discharging portion for biasing a lubricant supplied from the fulcrum portion in a direction toward the first slide-contact surface and discharging the lubricant. The fulcrum portion penetrates the rocker arm and is fastened to the rocker arm body. The fulcrum portion has a through hole supplying the lubricant to the lubricant discharging portion through the rocker arm body.

6 Claims, 18 Drawing Sheets

ROCKER ARM

CROSS REFERENCE TO RELATED APPLICATION

This application claims priority from Japanese Patent Application No. 2008-180453 filed Jul. 10, 2008. The entire content of this priority application is incorporated herein by reference.

BACKGROUND OF THE INVENTION

I. Technical Field

The present invention relates to a rocker arm of an internal-combustion engine.

II. Description of the Related Art

Traditional rocker arms utilized in valve trains of internal consumption engines are generally manufactured as forgings or casts. However, as revolution and output power of the internal consumption engines have increased in recent years, there has been an increasing desire for inertial-weight saving. Accordingly, arts for manufacturing the rocker arms by plastic working (such as press working) have been proposed for the purpose of weight saving. One of such art is disclosed in Japanese Unexamined Patent Application Publication No. 2007-056690.

However, it is difficult to perform drilling with high accuracy for the rocker arms manufactured by press working. Therefore, while each cam follower has a portion on a surface thereof that makes sliding contact with each cam (this portion of the surface of the cam follower will be hereinafter be referred to simply as "the slide-contact surface of the cam follower"), it has been assumed that it is difficult to realize any oil passage for supplying lubricant to the slide-contact surface of the cam follower. Therefore, according to proposed methods, supply of lubricant to such rocker arms has been not through the rocker arms themselves but through other paths (such as what is usually referred to as shower flow) outside the rocker arms.

However, mounting of the other paths such as the shower flow has problems such as increase in internal volume and in weight of the internal consumption engines along with mounting of the other paths. On the other hand, the inventors of the present invention found that, since lubricant supply from the other path is farther in comparison with lubricant supply from the rocker arm onto itself, it is difficult to efficiently supply lubricant to the slide-contact surface of the cam follower. This is not limited to the rocker arms manufactured by press working. V-engines, which have been spreading recent years, brought increase in number of camshafts and valves, which then brought increase in load that the camshafts bear. Along with this, there has been an increasing desire for higher efficiency in lubricant supply.

Thus, there is a need in the art for a rocker arm that can improve the efficiency of supplying lubricant to the slide-contact surface of the cam follower.

SUMMARY OF THE INVENTION

[First Example of Adoption] One aspect of the present invention can include a rocker arm configured to be swingably supported by a support portion of an internal-combustion engine and to be driven in a swinging manner by a cam, the rocker arm comprising: a rocker arm body including a cam follower having a first slide-contact surface, wherein the first slide-contact surface is in sliding contact with the cam to function as a point where force is applied; a fulcrum portion including a second slide-contact surface, wherein the second slide-contact surface is swingably in sliding contact with respect to the support portion to function as a fulcrum; and a lubricant discharging portion for biasing a lubricant supplied from the fulcrum portion in a direction toward the first slide-contact surface and discharging the lubricant. The fulcrum portion penetrates the rocker arm body from a side corresponding to the first slide-contact surface to a side corresponding to the second slide-contact surface and is fastened to the rocker arm body, and the fulcrum portion has a through hole supplying the lubricant supplied to the second slide-contact surface at a location of penetration to the lubricant discharging portion through the rocker arm body.

The rocker arm of the first example of adoption has an oil passage for leading the lubricant supplied to the second slide-contact surface that functions as the fulcrum to a surface of the rocker arm body. The surface corresponds to the first slide-contact surface that functions as the point where force is applied by going through the through hole formed in the support portion. The lubricant supplied by this oil passage is, further, biased in the direction toward the first slide-contact surface and is discharged. Therefore, the lubricant supplied to the second slide-contact surface can be supplied through the rocker arm body without forming any oil passage inside the rocker arm body.

Thus, the rocker arm of the first example of adoption has an advantage that efficient lubricant supply can be easily realized by eliminating the necessity of forming the oil passage inside the rocker arm body. It is found that this advantage has significant value from at least one view as follows: (1) formation of the oil passage that penetrates the rocker arm body and efficiently supplies lubricant in the direction toward the first slide-contact surface needs accurate cutting; (2) the shape of the rocker arm body is restricted for ensuring a forming position of the oil passage (for example, an excessive plate thickness is required); and (3) in a case of manufacturing the rocker arm by sheet-metal plastic working, any one of the above is difficult and, therefore, plastic working cannot be utilized for manufacturing the rocker arm body.

Note that the oil passage penetrating the sheet-metal rocker arm body is required because it is the first slide-contact surface that functions as the point where force is applied (that receives cyclic load from the cam) that most needs lubricant supply, while the point where lubricant is supplied from the internal combustion engine (e.g. a cylinder head) from the rocker arm have to be the second slide-contact surface that is in continuous contact with the cylinder head and functions so as to support as the fulcrum of the cyclic load from the point where force is applied. That is, because lubricant supply to the point where force is applied of the sheet-metal rocker arm body have to be supplied from the fulcrum that produces a drag against the load applied to this point where force is applied from the opposite side.

Furthermore, "biasing lubricant supplied from the fulcrum portion in a direction toward the first slide-contact surface" should only be that the flow direction of the lubricant supplied from the through hole approaches to the direction toward the first slide-contact surface rather than the supply direction by the through hole; it can unnecessary match with the direction toward the first slide-contact surface. In embodiments, the "through hole" and the "lubricant discharging hole" correspond, for example, to a "through hole 120*h*" and a "lubricant discharging hole 110*j*", respectively.

[Second Example of Adoption] The rocker arm body is manufactured by plastic working.

With the rocker arm of the second example of adoption, the rocker arm body is manufactured by plastic working. Therefore, production performance can be significantly improved.

[Third Example of Adoption] The lubricant discharging portion is engaged in an arbitrary direction with respect to the rocker arm body by a concave-convex shape formed on the lubricant discharging portion and a concave-convex shape formed at the fulcrum portion.

With the rocker arm of the third example of adoption, the lubricant discharging portion is engaged with the rocker arm body in the arbitrary direction by the concave-convex shape formed on the lubricant discharging portion and the concave-convex shape formed on the fulcrum portion. Therefore, the lubricant discharging portion can be easily mounted in a state oriented in the direction toward the first slide-contact surface.

Note that, in the embodiments, the concave-convex shape formed on the lubricant discharging portion corresponds to a "claw portion 160*c*". The concave-convex shape formed on the fulcrum portion corresponds, in the embodiments, a "screw thread of the fulcrum bolt 120*a*". Note however that the concave-convex to the embodiment is not limited to the embodiments; the concavity and the convexity may be replaced with each other.

[Fourth Example of Adoption] The through hole has a stepped shape narrowing toward the lubricant discharging portion and having at least one step, the lubricant discharging portion includes a shape for fitting in the stepped shape and is capable of elastically deforming to a size for being capable of passing through a portion having a most small inner diameter of the stepped shape, and the lubricant discharging portion includes a hole that is in communication with the through hole.

The rocker arm of the fourth example of adoption has characteristics that the engaging force increases as the lubricant oil pressure becomes higher. Therefore, the required level of rigidity and mechanical strength of the lubricant discharging portion can be comparatively reduced. Therefore, the rocker arm of the fourth example of adoption has an advantage that down-sizing of members and weight saving is allowed for.

[Fifth Example of Adoption] The lubricant discharging portion includes a flange portion for positioning a direction with respect to the rocker arm body.

[Sixth Example of Adoption] The flange portion has a shape that matches with a predetermined location of an outer contour of the rocker arm body.

Note that the present invention can be realized by various modes other that the above. For example, the present invention can be realized by modes such as a method of manufacturing a rocker arm, an internal combustion engine having the rocker arm, or an automobile including such an internal combustion engine.

While the cam follower has the slide-contact surface that makes sliding contact with the cam, the present invention can provide a technique for more efficient lubricant supply to the slide-contact surface of the cam follower.

DESCRIPTION OF THE PREFERRED INVENTION

Embodiments in accordance with the present invention will be described in an order as follows:

A. Configuration of Valve Train;
B. Configuration of Rocker Arm of First Embodiment;
C. Configuration of Rocker Arm of Second Embodiment;
D. Configuration of Rocker Arm of Third Embodiment; and
E. Modified Embodiments.

A. Configuration of Valve Train

Figure 1:
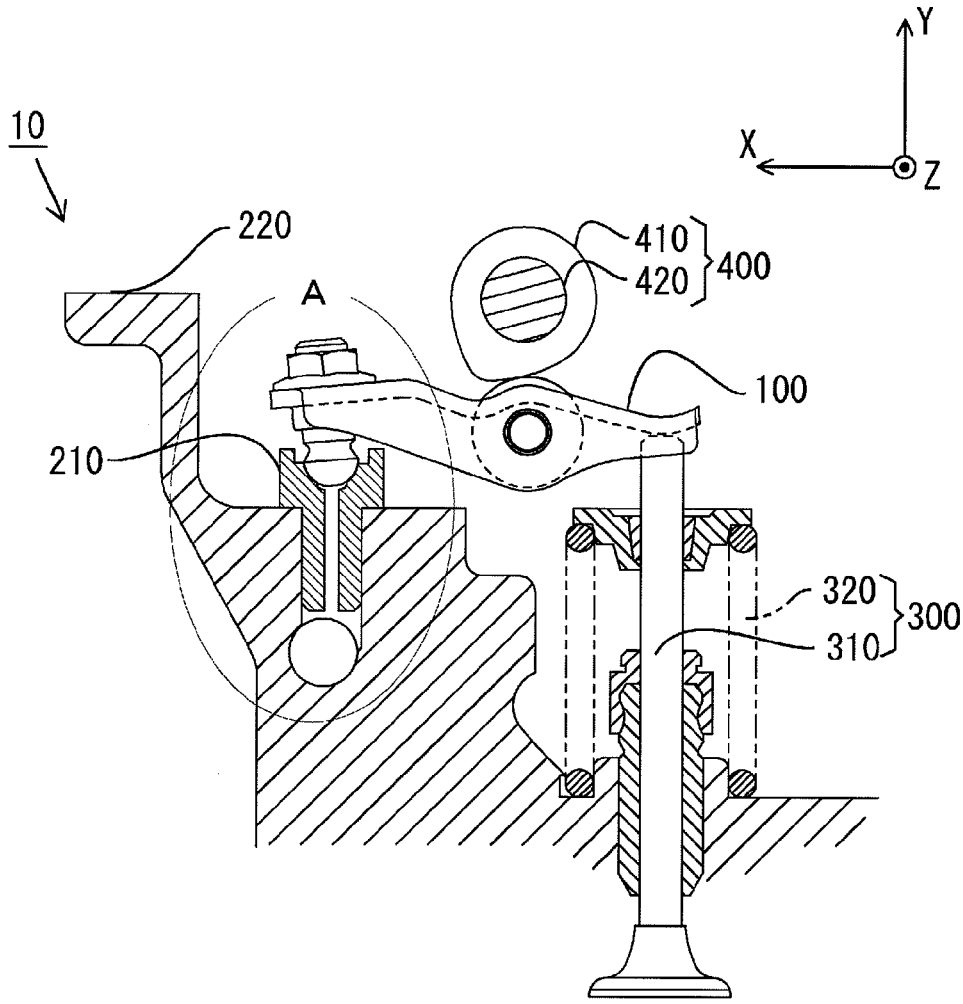
FIG. 1 is an explanatory view showing a valve train 10 including a rocker arm of an embodiment in a first embodiment in accordance with the present invention.

FIG. 1 is an explanatory view showing a valve train 10 including a rocker arm 100 of a first embodiment in accordance with the present invention. The valve train 10 includes a valve mechanism 300, the rocker arm 100, a camshaft 400, a support member 210, and a cylinder head 220. The valve mechanism 300 is driven by the rocker arm 100. The rocker arm 100 is driven in a swinging manner by the camshaft 400. In FIG. 1, each of the X-axis and the Z-axis represents the horizontal direction, while the Y-axis represents the vertical direction.

The support member 210 and the valve mechanism 300 are mounted in the cylinder head 220. The valve mechanism 300 includes a valve 310 and a valve spring 320. The valve 310 opens and closes an opening portion (not illustrated) of a combustion chamber. The valve spring 320 biases the valve 310 in a direction to close the opening portion. A shaft portion 420 and a cam 410 is formed in the camshaft 400. The support member 210 is screwed up (not illustrated) in the cylinder head 220. The rocker arm 100 is swingably supported by the support member 210 that serves as a fulcrum of the rocker arm 100. The swinging mechanism of the rocker arm 100 and the lubricant supply mechanism will be described below.

B. Configuration of Rocker Arm of First Embodiment

Figure 2:
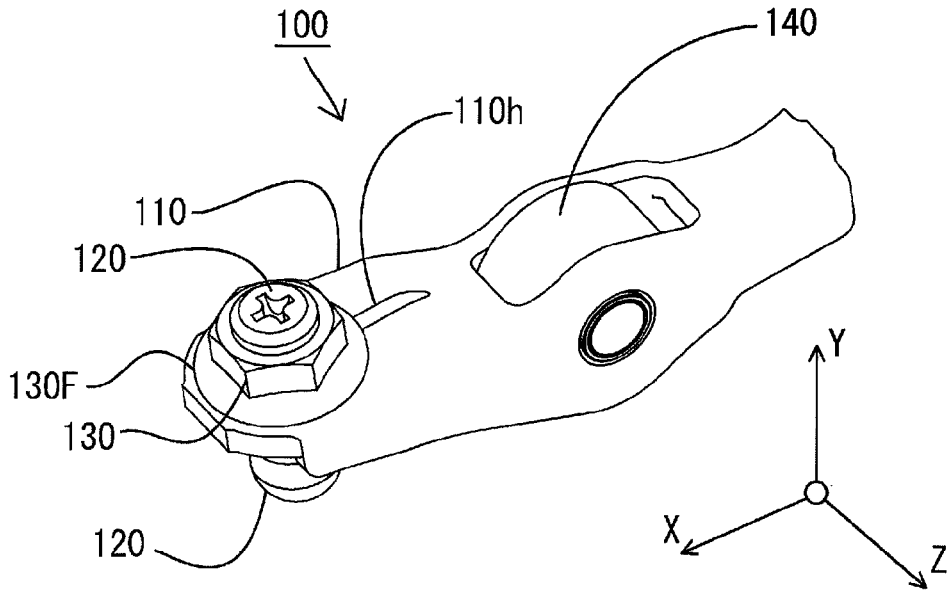
FIG. 2 is a perspective view showing an exterior of the rocker arm 100 of the first embodiment.

FIG. 2 is a perspective view showing an exterior of the rocker arm 100 of the first embodiment. The rocker arm 100 includes a sheet-metal rocker arm body 110, a roller 140, a fulcrum bolt 120, and a nut 130. The sheet-metal rocker arm body 110 is formed by press working (plastic working). The roller 140 functions as a cam follower (a point where force is applied) that is in sliding contact with the cam 410. The fulcrum bolt 120 can be in sliding contact with a concavity (described below) of the support member 210, and thus the rocker arm is swingably supported by the fulcrum bolt 120. The fulcrum bolt 120 is fastened to the sheet-metal rocker arm body 110 with the nut 130. A groove portion 110*h* is formed in the sheet-metal rocker arm body 110. A flange 130F is provided around the nut 130. The function of the groove portion 110*h* and the flange 130F will be described below.

The sheet-metal rocker arm body 110 is formed by press working in order to save weight and to improve the manufacturing efficiency. Most of traditional rocker arms utilized in valve trains of internal-combustion engines are manufactured by performing cutting for forgings or casts. However, as revolution and output power of the internal consumption engines are increasing in recent years, there has been an increasing desire for inertial-weight saving. Accordingly, arts for manufacturing the rocker arms by plastic working (such as press working) have been proposed for the purpose of weight saving. One of such arts is disclosed in Japanese Unexamined Patent Application Publication No. 2007-056690. Furthermore, differently from forgings or casts, which requires cutting processing after forging or casting, manufacture by press working requires only plastic working of a sheet-metal by press machines and, therefore, provides a higher manufacturing efficiency. Furthermore, press working allows for continuous processing and, therefore, is suitable for mass-produced products such as the rocker arms.

Figure 3:
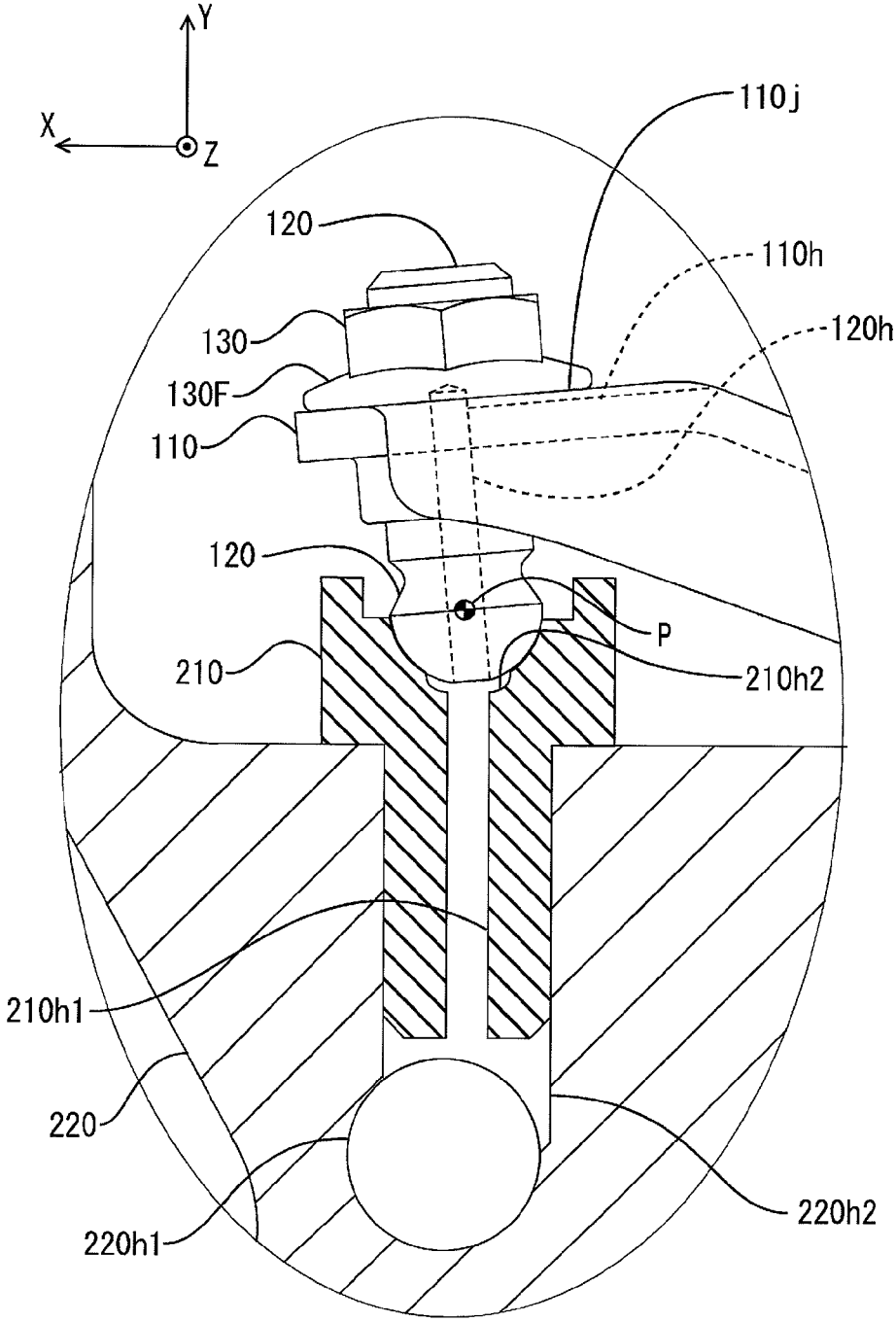
FIG. 3 is an explanatory view showing a lubricant supply path to a sheet-metal rocker arm body 110 of the first embodiment.

FIG. 3 is an explanatory view A (see FIG. 1) showing the lubricant supply path to the sheet-metal rocker arm body 110 of the first embodiment. A lubricant distribution hole 220*h*1 is formed in the Z-axis direction inside the cylinder head 220. Lubricant is distributed to each (not illustrated) of a plurality of the sheet-metal rocker arm bodies 110 via the lubricant distribution hole 220*h*1. A lubricant supply hole 210*h*1 is formed in the support member 210, while a lubricant supply hole 220*h*2 is formed in the Y-axis direction. The lubricant distributed from the lubricant distribution hole 220*h*1 is led to the lubricant supply hole 210*h*1 via the lubricant supply hole 220*h*2 and then is supplied to a lubricant supply recess 210*h*2.

While the fulcrum bolt 120 has a slide-contact surface that is in sliding contact with the support member 210 (this slide-contact surface corresponds to a "second slide-contact surface"), the lubricant supplied to the lubricant supply recess 210*h*2 in the above manner forms an oil layer in the slide-contact surface of the fulcrum bolt 120. This oil layer functions to reduce direct contact of the fulcrum bolt 120 with the support member 210 and thereby reduce friction due to sliding contact.

Next, while each roller 140 has a portion on a surface thereof that is in sliding contact with the cam 410 (this portion of the surface of the roller 140 corresponds to a "first slide-contact surface" and will be hereinafter be referred to simply as "the slide-contact surface of the roller 140"), the lubricant supplied to the lubricant supply recess 210*h*2 is supplied to the slide-contact surface of the roller 140 via a through hole 120*h* formed in the fulcrum bolt 120 and the groove portion 110*h* and forms an oil layer.

Figure 4:
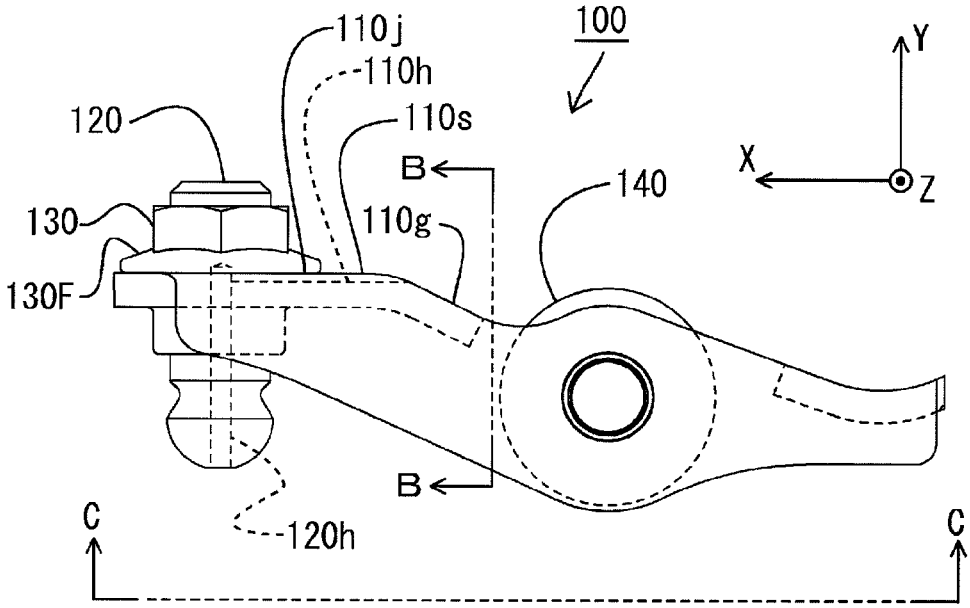
FIG. 4 is a side view (as viewed from the lateral direction) of the rocker arm 100 of the first embodiment.

FIGS. 4 and 5 are explanatory view showing the lubricant supply paths of the rocker arm 100 of the first embodiment. FIG. 4 is a side view (as viewed from the lateral direction) of the rocker arm 100 of the first embodiment. As found from these views, a lubricant discharging hole 110*j* for discharging lubricant is formed in the abutting interface between the nut 130 with the flange 130F and the sheet-metal rocker arm body 110. The lubricant discharging hole 110*j* is in communication with the through hole 120*h*.

The flange 130F is formed around the nut 130 to extend the lubricant discharging hole 110*j* because turbulent flow produced at a turning portion of a communicating portion between the through hole 120*h* and the lubricant discharging hole 110*j* can be reduced, and thereby the direction of a vector (indicating a quantity and a direction concerning discharging) of lubricant can be arranged to produce laminar flow of lubricant.

The groove portion 110*h* is formed in a surface of a lubricant sliding face 110*s*. The groove portion 110*h*, in conjunction with the nut 130 with the flange 130F, forms the lubricant discharging hole 110*j*. The lubricant sliding face 110*s* is formed on the sheet-metal rocker arm body 110 by press working. While the lubricant has a discharging vector produced at the lubricant discharging hole 110*j*, the lubricant sliding face 110*s* is a face formed in a direction to cause the lubricant to slide thereon and thereby maintain the discharging vector to the vicinity of the slide-contact surface of the roller 140.

Note that the lubricant sliding face 110*s*, the groove portion 110*h*, the lubricant discharging hole 110*j*, the nut 130, and the flange 130F are related as follows: the flange 130F configures a part of the nut 130; the groove portion 110*h* configures a part of the lubricant sliding face 110*s*; the lubricant discharging hole 110*j* is configured by the nut 130 with the flange 130F and a part of the groove portion 110*h*. Thus, the lubricant discharged from the lubricant discharging hole 110*j* slides on the surface of the lubricant sliding face 110*s* mainly along a portion of the groove portion 110*h* which does not configure the lubricant discharging hole 110*j*.

The discharging vector can be maintained by causing the lubricant to slide on the lubricant sliding face 110*s* because a mechanism as follows works. Namely, while the sheet-metal rocker arm body 110 is moved up by the swinging movement of the sheet-metal rocker arm body 110, the lubricant is pushed up by the lubricant sliding face 110*s*. On the other hand, while the sheet-metal rocker arm body 110 is going down, the lubricant is drawn to the lubricant sliding face 110*s* via Bernoulli's principle. Particularly, the inventors found that, at a time of high-speed revolution, viscosity decreases due to temperature rise of the lubricant, and flow velocity of the lubricant increases and, therefore, the lubricant that slides on the lubricant sliding face 110*s* as a constant flow of incompressible lubricant is strongly drawn to the lubricant sliding face 110*s* via Bernoulli's principle.

The lubricant sliding face 110*s* is formed further continuously to a lubricant guiding face 110*g* formed on the sheet-metal rocker arm body 110. The function of the lubricant guiding face 110*g* will be described below.

Figure 5A:
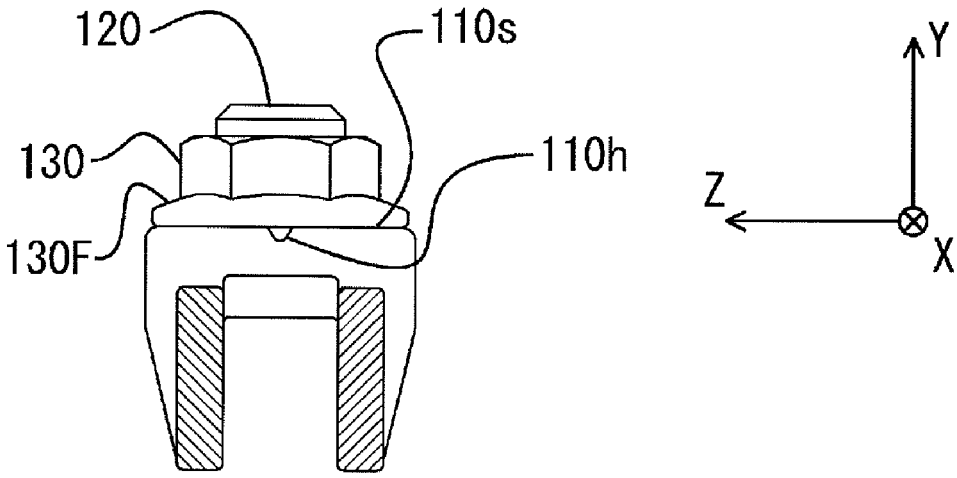
FIG. 5A is an explanatory view showing a lubricant supply path of the rocker arm 100 of the first embodiment.
Figure 5B:
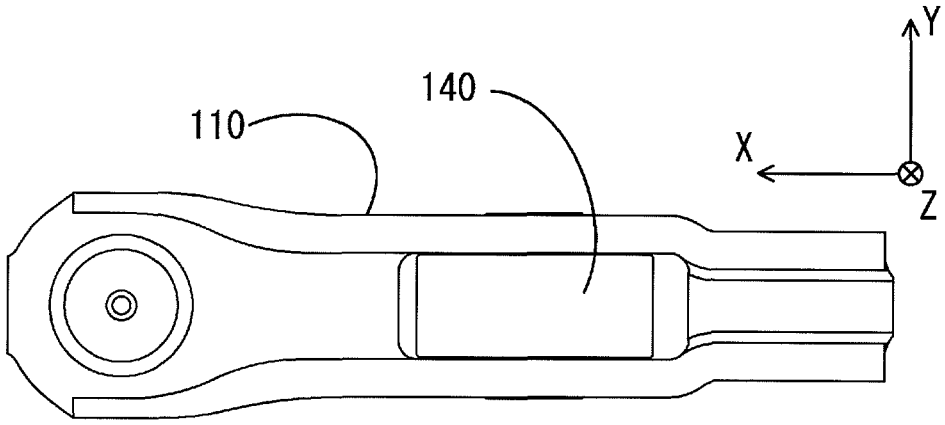
FIG. 5B is an explanatory view showing a bottom view (as viewed from below) of the rocker arm of the first embodiment.

FIG. 5A shows a cross sectional view of the rocker arm 100 taken along the line B-B in FIG. 4. FIG. 5B shows a bottom view (as viewed from below) of the rocker arm 100 taken along the line C-C in FIG. 4. As found from FIG. 5A, the groove portion 110*h* is formed as not a through hole but as a groove that is in contact with the outside. The groove portion 110*h* is formed as the groove in contact with the outside in order to enable the groove portion 110*h* to be formed by adjustment of the shape of die used in the press working.

Figure 6:
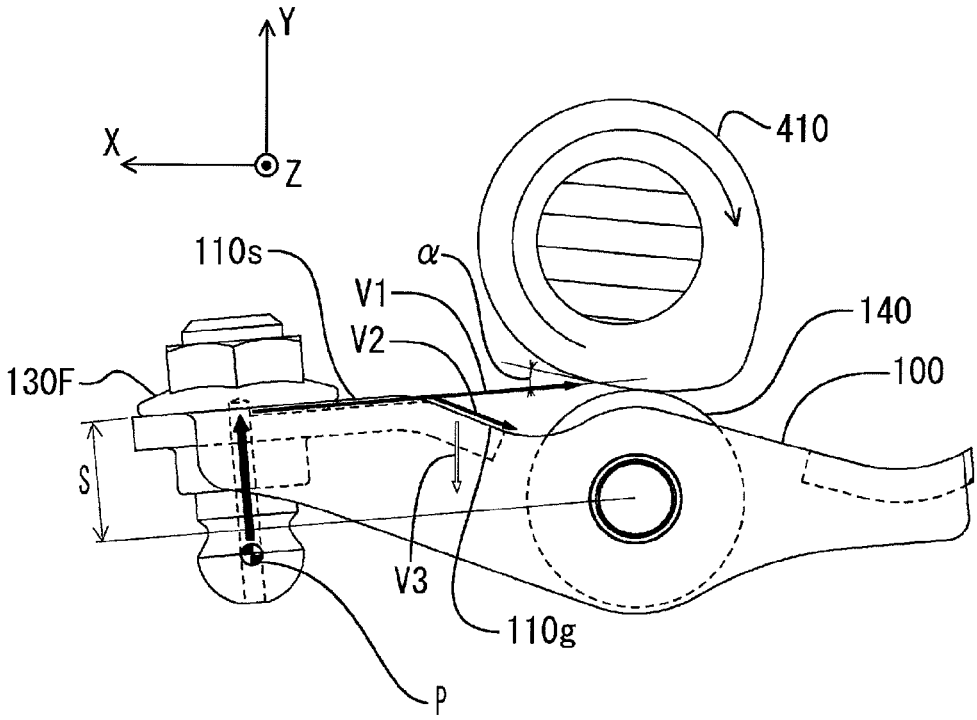
FIG. 6 is an explanatory view showing the lubricant supply condition of the rocker arm 100 of the first embodiment.

FIG. 6 is an explanatory view showing a lubricant supply manner of the rocker arm 100 of the first embodiment. In FIG. 6, black bold arrows indicate the lubricant flow, while the arrow in the cam 410 indicates the rotational direction of the cam 410. The rocker arm 100 is configured to be capable of suitably supplying lubricant over a wide operating range from the start time of the internal combustion engine (not illustrated) to the time of its high-speed revolution.

At the start time of the internal combustion engine, the lubricant supply pressure is low and, accordingly, the lubricant is supplied in a direction of an arrow V2. The lubricant supply path is supplied along the groove portion 110*h* formed in the lubricant sliding face 110*s* to the lubricant guiding face 110*g*. The lubricant supplied to the lubricant guiding face 110*g* is, by surface tension and by centrifugal force, guided along the lubricant guiding face 110*g* and approaches the vicinity of the slide-contact surface of the roller 140. This is because the lubricant guiding face 110*g* has a shape to pull away the lubricant from the location of a fulcrum P and to move the lubricant closer to the slide-contact surface of the roller 140.

The lubricant supplied to the lubricant guiding face 110*g* in the above manner is, by inertial force including centrifugal force that is produced by the turning movement (the swinging movement) about the fulcrum P of the rocker arm 100, efficiently and in a scattered fashion applied to a comparatively wider area on the cam 410 and the roller 140.

Note that the inventors found that, if the lubricant guiding face 110*g* is not formed, the lubricant falls in a direction of an arrow V3 at the start time of the internal combustion engine, and the lubricant cannot be efficiently supplied. It was found by analysis and experiments performed by the inventors that this phenomenon is caused by a plurality of synergistically involving factors such as follows: at the start time of the internal combustion engine, (1) the lubricant supply pressure is lower; (2) the lubricant temperature is lower and the viscosity is higher; and (3) the speed of the turning movement (the swinging movement) about the fulcrum P of the sheet-metal rocker arm body 110 is lower.

On the other hand, at the time of normal operation and high-speed operation of the internal combustion engine, the rocker arm 100 can efficiently supply a large quantity of lubricant in a direction of an arrow V1 to the cam 410 and the roller 140. Supply of the large quantity of lubricant is required at the time of the high-speed operation because the cam 410 and the roller 140 rotationally swing at a high speed and, accordingly, cause the lubricant to be scattered therefrom by inertial force and centrifugal force.

In this embodiment, efficient lubricant supply in such a condition is realized by the configurations that (1) lubricant is discharged to the vicinity of the slide-contact surface of the roller 140 and (2) the surface of the cam 410 and the lubricant discharging direction make a smaller angle α. The configuration that lubricant is discharged to the vicinity of the slide-contact surface of the roller 140 allows the lubricant to be supplied to the slide-contact surface, and the oil layer can formed, before the lubricant is scattered from the cam 410 and the roller 140. On the other hand, the configuration that the surface of the cam 410 and the lubricant discharging direction make the smaller angle α serves an effect that, while lubricant is discharged at the high speed onto the surface of the cam 410, bounce of the lubricant therefrom is less.

The configuration that lubricant is discharged to the vicinity of the slide-contact surface during the swinging movement of the rocker arm 100 is realized by inclination of the lubricant discharging hole 110*j* and the lubricant sliding face 110*s* following the up-down movement of the roller 140 due to rotation of the cam 410. That is, when, for example, the roller 140 is upwardly moved by the swinging movement of the rocker arm 100, the lubricant discharging hole 110*j* and the lubricant sliding face 110*s* are upwardly inclined, and thus the lubricant discharging direction follows the slide-contact surface of the roller 140.

Note that, in practice, a time period elapses from departure of the lubricant from the lubricant sliding face 110*s* to arrival to the cam 410. The time delay due to this elapse of the time period allows a lubricant discharging position to swing within a narrow range in the vicinity of the slide-contact surface of the roller 140. The inventors of the present invention found also that the swinging range of the discharging position due to this time delay can be controlled by adjusting the length of the lubricant sliding face 110*s* and thereby changing the distance from the slide-contact surface of the roller 140.

Furthermore, the inventors of the present invention found that adjustment of the lubricant discharging vectors and a sliding length can be realized by adjusting a radial length of the flange 130F formed around the nut 130. That is, by extending the flange 130F, the turbulent flow produced at the turning portion in the communicating portion between the through hole 120*h* and the groove portion 110*h* can be reduced and thereby the lubricant discharging vector can be enlarged. It was found that such extension of the flange 130F increases attraction to the lubricant sliding face 110*s* while shortens the length of an open portion (a portion uncovered with the flange 130F) of the lubricant sliding face 110*s*. Thus, by adjusting a size of the flange 130F, the suitable lubricant supply path according to the lubricant supply quantity and a size of the cylinder (not illustrated) can be realized.

Thus, the lubricant discharging hole 110*j* and the lubricant sliding face 110*s* of the sheet-metal rocker arm body 110 of the rocker arm 100 serves the significant effect that a positional relation between the slide-contact surface and the discharging position and the swinging amount of the discharging position in the vicinity of the slide-contact surface can be controlled by adjusting the direction and the length of the lubricant discharging hole 110*j* and the lubricant sliding face 110*s* (the sliding portion).

On the other hand, the configuration that the surface of the cam 410 and the lubricant discharging direction make the smaller angle α is realized by forming the lubricant discharging hole 110*j* and the lubricant sliding face 110*s* at positions ensuring an offset S from the shaft of the roller 140. This is because the angle α is larger if the offset S is smaller. Note that, however, in order to ensure the offset S, there is a problem that the size of the sheet-metal rocker arm body 110 is enlarged in the direction corresponding to the vertical direction (the Y-axis direction) in FIG. 4.

By forming the lubricant discharging hole 110*j* and the lubricant sliding face 110*s* in an upper face of the sheet-metal rocker arm body 110, the inventors of the present invention succeeded in reducing such an adverse effect. Such formation of the lubricant discharging hole 110*j* and the lubricant sliding face 110*s* has been realized by the configuration of the lubricant supply passage via the through hole 120*h*, which is formed in the fulcrum bolt 120, and the groove portion 110*h*.

Creation of such a configuration goes against a traditional technical common knowledge. According to the traditional technical common knowledge, the rocker arms manufactured by sheet-metal press working has been realized to obtain high-speed revolution and high output intending for weight saving, while realization of the mechanism to supply lubricant with the face made by press working has not been assumed.

In such weight saving, it has been required as a technical common knowledge to separately provide a lubricant supply system (for example, what is usually referred to as showering, not illustrated) separately provided with lubricant supply to the rocker arm 100. In other words, it is traditionally held technical common knowledge that equipment of the lubricant supply system is required as an object of trade-off of weight saving. Furthermore, such a lubricant supply system supplies lubricant from the outside of the rocker arm 100 and, accordingly, causes a problem that efficient lubricant supply to the slide-contact surface is also difficult.

In addition, the sheet-metal rocker arm body 110 manufactured by sheet-metal press working causes problems such as "residual stress due to press working", "the low-accurate shape in comparison with cutting", "difficulty in ensuring a route for the lubricant supply hole due to thinness of the sheet metal". Therefore, it is a technical common knowledge that it is impossible in practice to form any lubricant supply hole by cutting. Furthermore, there is also a problem that, if the lubricant supply holes are formed in sheet-metal pressed parts by cutting, the cutting step is necessary only for the formation of the lubricant supply holes, which diminishes the advantages in sheet-metal press working.

The inventors of the present invention, upon considering that formation of the lubricant supply holes in the sheet-metal pressed parts is difficult, have dared not to form the lubricant discharging holes by cutting but have dared to create the new technical idea of utilizing the outer contour (e.g. the lubricant sliding face 110*s* and the groove portion 110*h*) of the sheet-metal pressed parts, which is absolutely different from the traditional thought. This embodiment is an illustrative aspect of the invention configured on the basis of the technical idea created as above.

As described above, this embodiment substantially maintains the advantages (such as weight saving and low cost) in sheet-metal press working while allows for realization of efficient lubricant supply to the slide-contact surface, which is traditionally allowed only by forgings or casts.

C. Configuration of Rocker Arm of Second Embodiment

Figure 7:
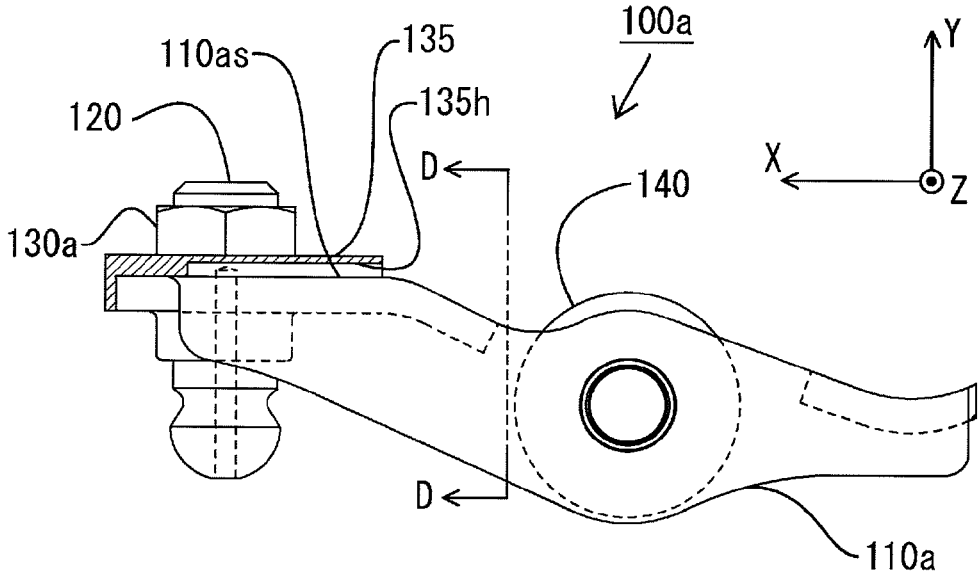
FIG. 7 is a fragmentary cross-sectional view (as viewed from the lateral direction) of a rocker arm 100*a* of a second embodiment.
Figure 8:
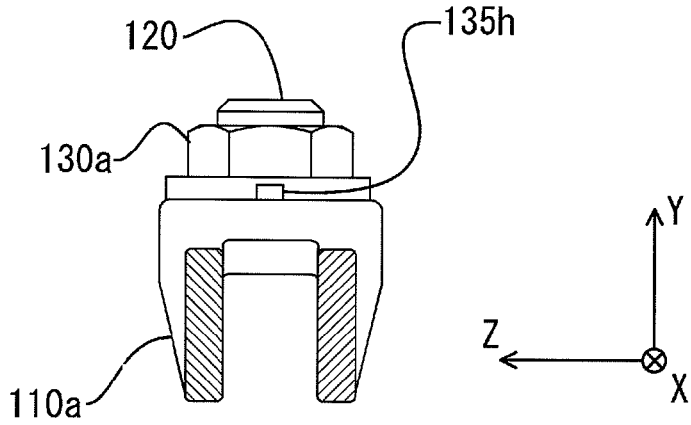
FIG. 8 is an explanatory view showing a lubricant supply path of the rocker arm 100*a* of the second embodiment.

FIG. 7 and FIG. 8 (taken along the line D-D in FIG. 7) are explanatory views showing the lubricant supply paths of a rocker arm 100*a* of a second embodiment. FIG. 7 is a cross-sectional view (as viewed from the lateral direction) of the rocker arm 100*a* of the second embodiment. As found from these figures, a lubricant sliding face 110*as* is formed in a sheet-metal rocker arm body 110*a* of the rocker arm 100*a*. Differently from the lubricant sliding face 110*s* of the first embodiment, the lubricant sliding face 110*as* has no groove portion.

On the other hand, in the second embodiment, instead of the groove portion 110*h* formed in the sheet-metal rocker arm body 110 of the first embodiment, a lubricant discharging member 135 having a groove portion 135*h* formed therein is fastened to the sheet-metal rocker arm body 110*a* of the second embodiment.

Figure 9:
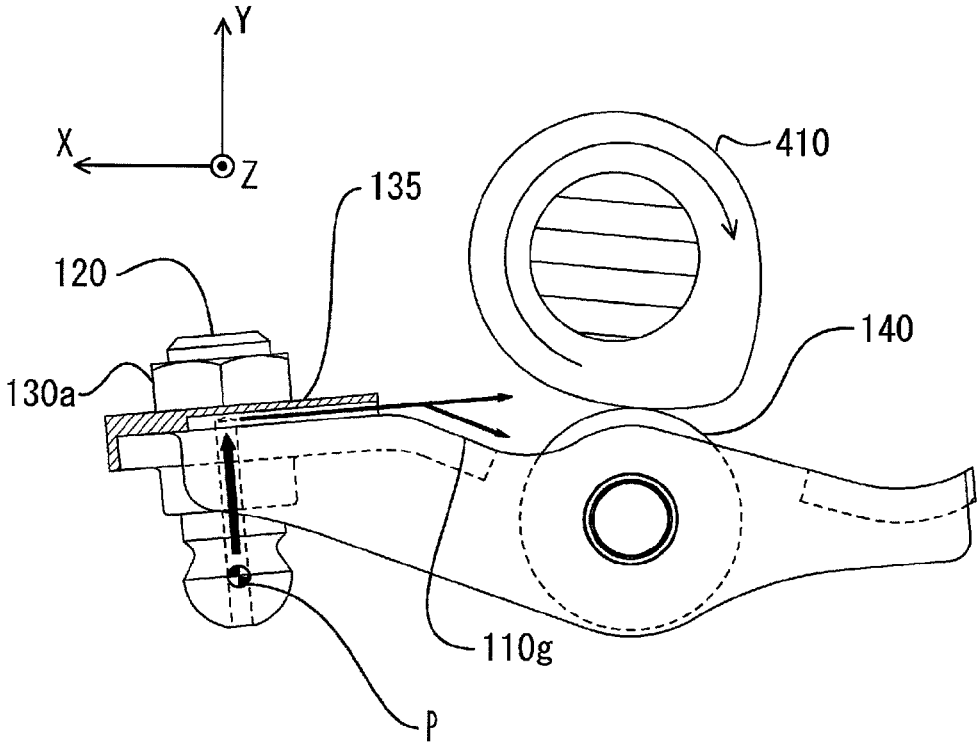
FIG. 9 is an explanatory view showing a lubricant supply condition of the rocker arm 100*a* of the second embodiment.

FIG. 9 is an explanatory view showing a lubricant supply manner of the rocker arm 100*a* of the second embodiment. As found from the black bold arrow indicating the lubricant flow, it is found that the lubricant can be efficiently supplied similar to the first embodiment. Thus, the groove does not have to be provided in the sheet-metal rocker arm body 110*a*; instead, the lubricant supply passage may be formed by facing the sheet-metal rocker arm body 110*a* with another member having the groove therein. Furthermore, the groove may be formed in each of the member and the sheet-metal rocker arm body 110*a*.

D. Configuration of Rocker Arm of Third Embodiment

Figure 10:
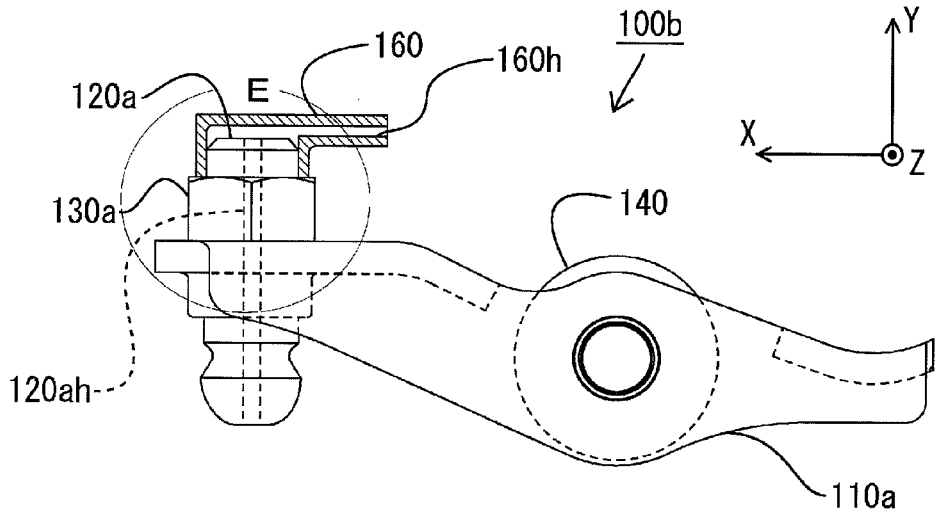
FIG. 10 is a fragmentary cross-sectional view (as viewed from the lateral direction) of a rocker arm 100*b* of a third embodiment.

FIG. 10 is a cross-sectional view (as viewed from the lateral direction) of a rocker arm 100*b* of a third embodiment. While each of the rocker arms of the above embodiments utilizes the outer contour of the sheet-metal rocker arm body 110, 110*a* to realize the function of discharging lubricant, the rocker arm 100*b* of the third embodiment differs from the above embodiments in that a lubricant discharging nozzle 160 itself realizes the function of discharging lubricant.

Figure 11:
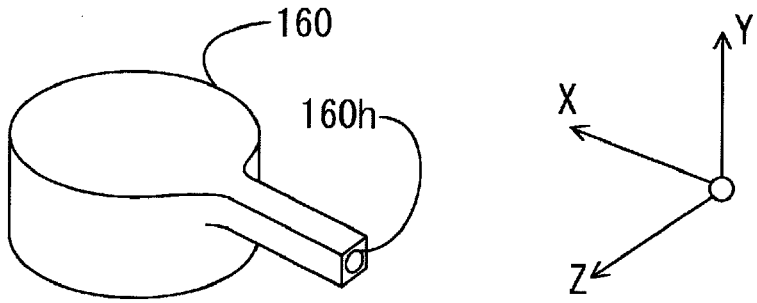
FIG. 11 is a perspective view showing an exterior of a lubricant discharging nozzle 160 of the rocker arm 100*b* of the third embodiment.

FIG. 11 is a perspective view showing an exterior of the lubricant discharging nozzle 160 that the rocker arm 100*b* of the third embodiment includes. In a case where, for example, requirements for accuracy in the lubricant discharging direction are strict, the lubricant discharging nozzle 160 may be manufactured as a metal member as a cutting-worked part; in a case where, for example, requirements for mass production cost and weight saving are strict, the lubricant discharging nozzle 160 may be manufactured as a product made of synthetic resin or other resin.

In this embodiment, lubricant supply to the lubricant discharging nozzle 160 is realized by a through hole 120*ah* that entirely penetrates both ends of fulcrum bolt 120*a*.

Figure 12:
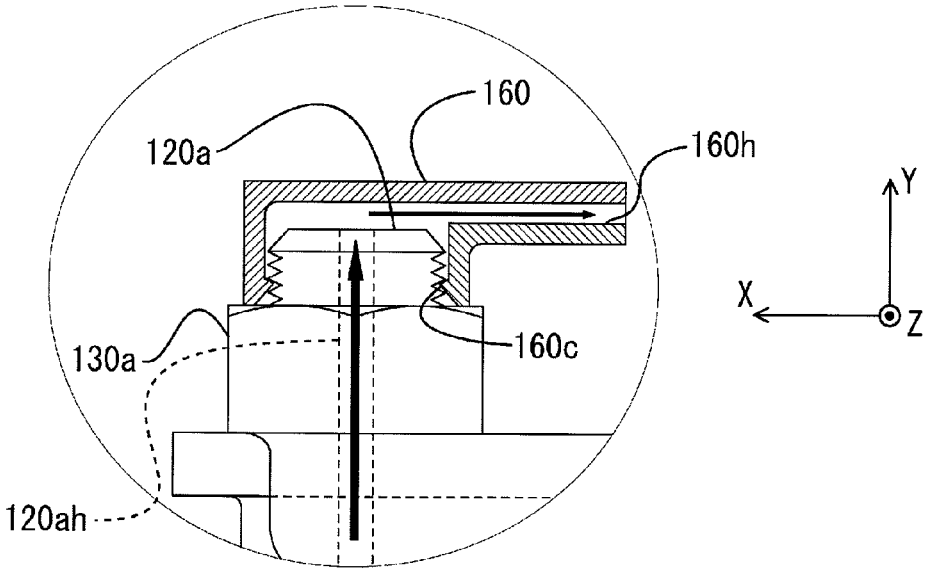
FIG. 12 is an explanatory view showing a lubricant supply path of the rocker arm 100*b* of the third embodiment in a state where the discharging nozzle 160 is mounted on the rocker arm 100*b;*

FIG. 12 is an explanatory view E (see FIG. 10) showing a lubricant supply path of the rocker arm 100*b* of the third embodiment in a state where the lubricant discharging nozzle 160 is mounted (see E of FIG. 10). The lubricant discharging nozzle 160 is mounted to the fulcrum bolt 120*a* by engaging a claw portion 160*c* with a screw thread of the fulcrum bolt 120*a*. Thus, the lubricant discharging nozzle 160 is not screwed up to the fulcrum bolt 120*a* but is engaged at the claw portion 160*c* in order to provide a latitude for the lubricant discharging nozzle 160 to orient the discharging direction in a suitable direction.

As described above, the third embodiment, differently from any one of the above-described embodiments, includes the lubricant discharging nozzle 160 that has the function of discharging lubricant by itself alone and that does not depend on the sheet-metal rocker arm body 110 for discharging lubricant. Taking this remarkable point, the inventors of the present invention found configurations as follows.

Figure 13:
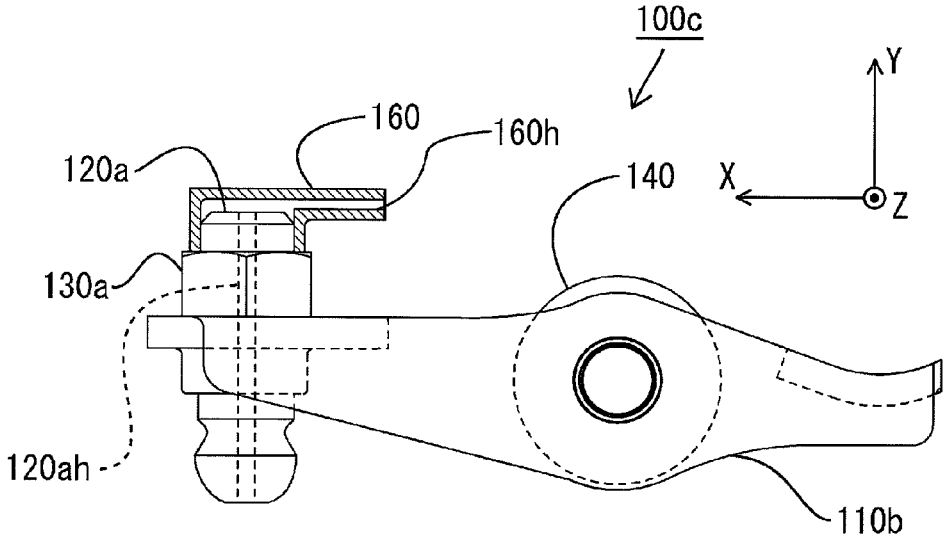
FIG. 13 is a fragmentary cross-sectional view (as viewed from the lateral direction) of a rocker arm 100*c* of a first modified illustration of the third embodiment.

FIG. 13 is a cross-sectional view (as viewed from the lateral direction) of a rocker arm 100*c* of a first modified illustration of the third embodiment. Differently from the third embodiment, the rocker arm 100*c* of the first modified illustration utilizes a typical rocker arm body 110*b* that does not assume forming of any lubricant discharging path.

As described above, the configuration of the third embodiment can be realized even with utilizing the typical sheet-metal rocker arm body 110*b* and can realize further weight saving. In a case where requirements for standardizing parts are strict, this configuration serves many uses as a preferred embodiment.

Figure 14:
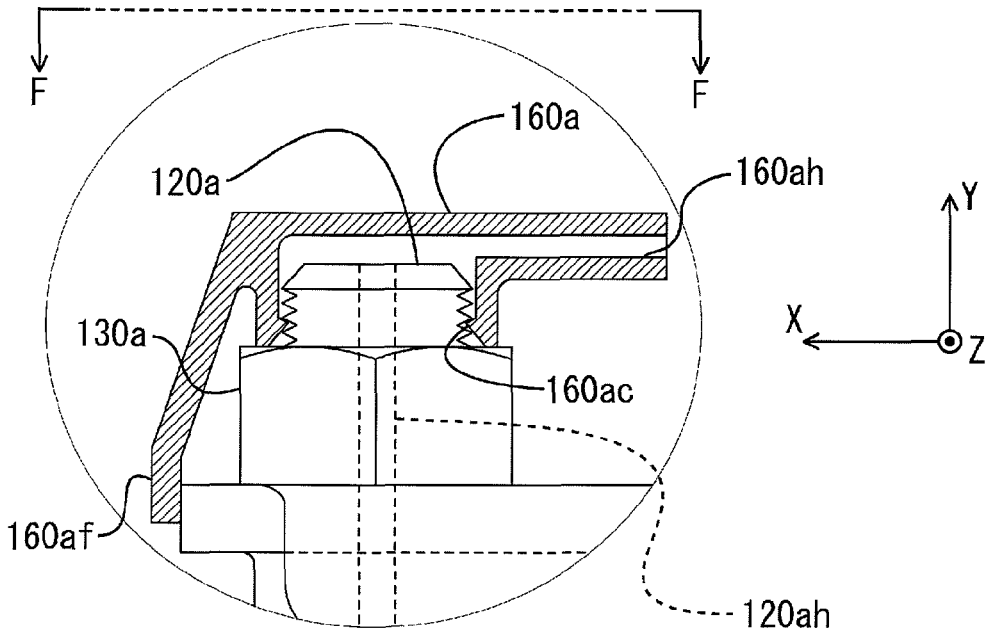
FIG. 14 is a fragmentary cross-sectional view (as viewed from the lateral direction) of a lubricant discharging nozzle 160*a* of a second modified illustration of the third embodiment.
Figure 15:
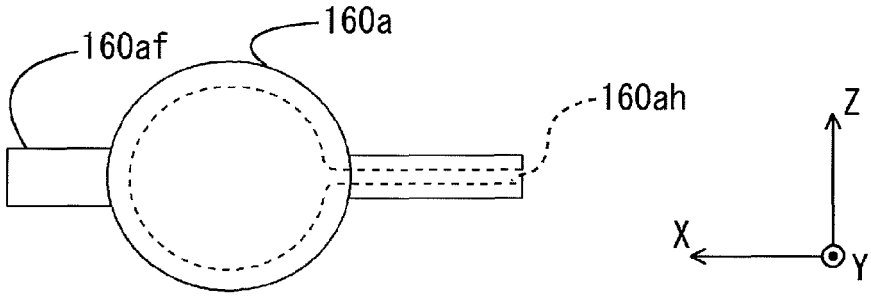
FIG. 15 is a front view (as viewed from above) of the lubricant discharging nozzle 160*a* of the second modified illustration.

FIG. 14 is a cross-sectional view (as viewed from the lateral direction) of a lubricant discharging nozzle 160*a* of a second modified illustration of the third embodiment. FIG. 15 is a front view (as viewed from above) of the lubricant discharging nozzle 160*a* of the second modified illustration. Differently from the lubricant discharging nozzle 160, the lubricant discharging nozzle 160*a* of the second modified illustration has a flange 160*af* to be engaged with an outer contour of any one of the sheet-metal rocker arm body 110, 110*a*, 110*b* and to position the discharging direction of the lubricant discharging nozzle 160*a*.

This configuration serves many uses as a preferred mode in a case where requirements for realizing a simpler assembling procedure under consideration of positioning the discharging direction of the lubricant discharging nozzle 160*a* and for preventing variation of the discharging direction are strict.

Figure 16:
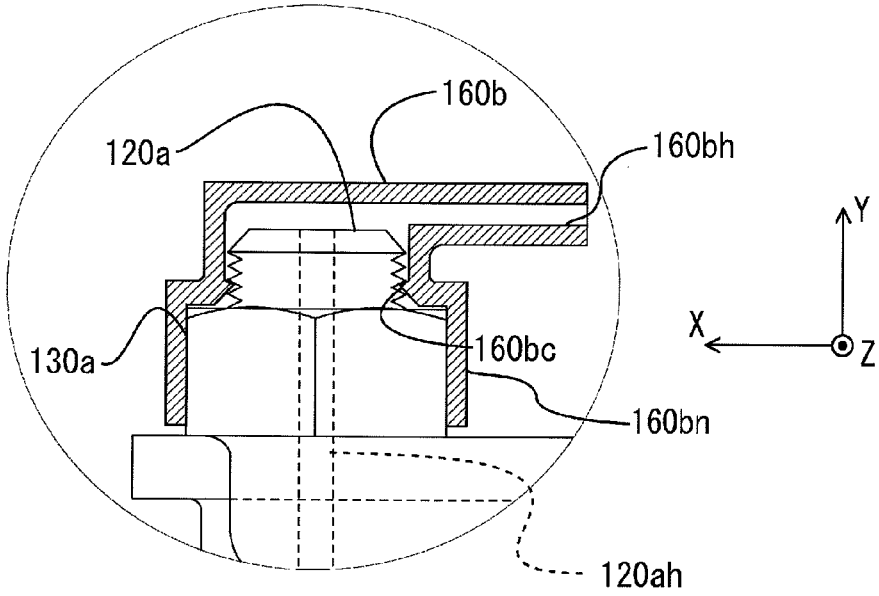
FIG. 16 is a fragmentary cross-sectional view (as viewed from the lateral direction) of a lubricant discharging nozzle 160*b* of a third modified illustration of the third embodiment.

FIG. 16 is a cross-sectional view (as viewed from the lateral direction) of a lubricant discharging nozzle 160*b* of a third modified illustration of the third embodiment. Differently from the lubricant discharging nozzle 160*a*, the lubricant discharging nozzle 160*b* of the third modified illustration has a flange 160*bn* to be engaged with an outer contour of a nut 130*a* and to position the discharging direction of the lubricant discharging nozzle 160*a*.

Note that, in a case of being engaged with the outer contour of the nut 130*a* and positioning the discharging direction of the lubricant discharging nozzle 160*b*, it is preferable not to be in a screwing-up configuration such as the nut 130*a* but to be a tightening-up member whereby the direction can be freely set.

Figure 17:
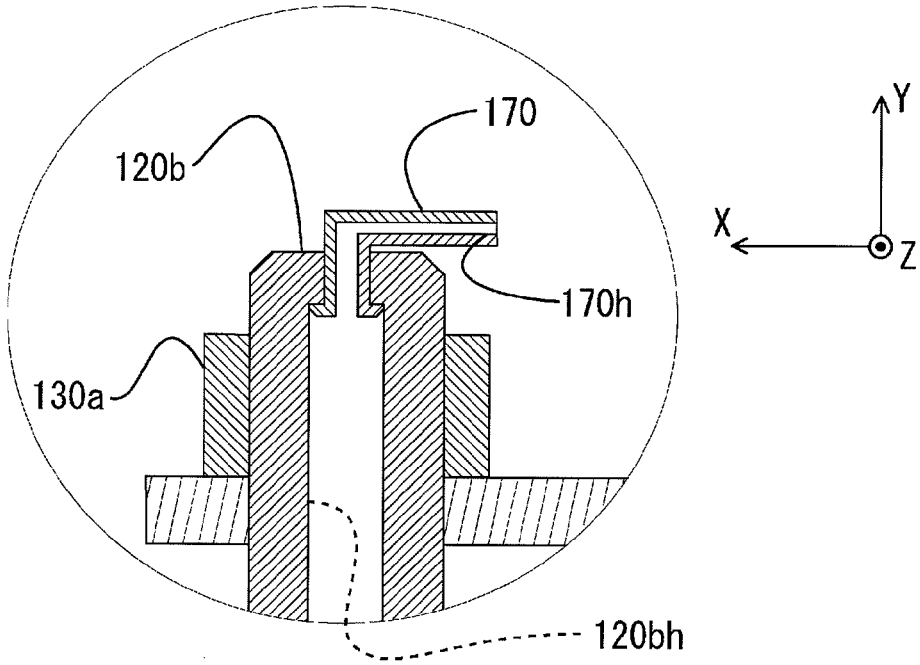
FIG. 17 is a cross-sectional view (as viewed from the lateral direction) of a lubricant discharging nozzle 170 of a fourth modified illustration of the third embodiment.

FIG. 17 is a cross-sectional view (as viewed from the lateral direction) of a lubricant discharging nozzle 170 of a fourth modified illustration of the third embodiment. Differently from any one of the lubricant discharging nozzles 160, 160*a*, 160*b*, the lubricant discharging nozzle 170 of the fourth modified illustration is configured to be engaged with a stepped through hole 120*bh* that is formed through a fulcrum bolt 120*b*.

This configuration has advantages that the engaging force increases as the lubricant oil pressure becomes higher and that the members can be downsized and save weight. Therefore, in a case where, for example, requirements for weight saving are strict, the configuration serves many use as the preferred embodiment.

Furthermore, this configuration allows for a minute positioning key groove (not illustrated) to be formed in the stepped through hole 120*bh* side and a fitting key (not illustrated) in the lubricant discharging nozzle 170 side so that positioning is easier to perform. This configuration has an advantage also that a fitting force between the key and the key groove increases as the lubricant oil pressure becomes higher.

E. Modified Embodiments

While several embodiments in accordance with the present invention are described as above, the present invention is not limited to these embodiments; other illustrative aspects are also included within the scope of the present invention. Particularly, the elements that are described in any one of the embodiments but are not recited in the independent claim(s) are additive ones and, therefore, can be omitted.

E-1. First Modified Embodiment: any one of the above embodiments illustrates the rocker arm of a swing-arm type. The present invention is not limited to the swing-arm type; the present invention can be adopted to rocker arms of a seesaw type. With the rocker arms of the seesaw type, the positional relation between the fulcrum and the point where force is applied are opposite from that of the swing-arm type.

E-2. Second Modified Embodiment: not all of each of the advantages and the effects described in the above embodiments are related with the essential elements of the present invention; the present invention allows for design variation for easily realizing each of the above advantages and effects. That is, it is only necessary to realize at least one of the advantages or effects.

E-3. Third Modified Embodiment: any one of the above embodiments discloses the configuration as follows: forming the groove in the sheet-metal rocker arm body and forming the lubricant discharging opening by joining the sheet-metal rocker arm body and a fulcrum portion (the first embodiment); forming the groove in the fulcrum portion and forming the lubricant discharging opening by joining the fulcrum portion and the sheet-metal rocker arm body (the second embodiment); and providing the additional member having the lubricant discharging opening to the rocker arm (the third embodiment). However, not limited to these illustrative aspects, for example, a through hole may be formed in the nut 130 itself. Note however that, in the case of forming the through hole in the nut 130 itself, not the screwing-up configuration as of the nut 130 but a tightening-up member can freely set the direction is preferable.

E-4. Fourth Modified Embodiment: while the rocker arm body is manufactured by sheet-metal press working (plastic working) in any one of the above embodiments, the rocker arm body may be manufactured by, for example, casting and cutting.

What is claimed is:

1. A rocker arm configured to be swingably supported by a support portion of an internal-combustion engine and to be driven in a swinging manner by a cam, said rocker arm comprising:

a rocker arm body including a cam follower having a first slide-contact surface, wherein said first slide-contact surface is configured to be in sliding contact with the cam to function as a point where force is applied;

a fulcrum bolt including a second slide-contact surface, wherein said second slide-contact surface is configured to be swingably in sliding contact with respect to the support portion to function as a fulcrum;

a lubricant discharging nozzle configured to discharge lubricant supplied from said fulcrum bolt while biasing the lubricant in a direction toward said first slide-contact surface, said lubricant discharging nozzle being attached to said fulcrum bolt; and a nut fastening said fulcrum bolt to said rocker arm body, wherein said fulcrum bolt penetrates said rocker arm body and is fastened to said rocker arm body by said nut, and said fulcrum bolt has a through hole supplying the lubricant supplied to said second slide-contact surface at a location of penetration to said lubricant discharging nozzle through said rocker arm body; and wherein said lubricant discharging nozzle has a claw portion, and said lubricant discharging nozzle is attached to said fulcrum bolt by engaging said claw portion with a screw thread of said fulcrum bolt.

2. The rocker arm according to claim 1, wherein said rocker arm body is manufactured by plastic working.

3. The rocker arm according to claim 1, wherein said lubricant discharging nozzle is engaged in an arbitrary direction with respect to said rocker arm body by a concave-convex shape formed at said lubricant discharging nozzle and a concave-convex shape formed at said fulcrum bolt.

4. The rocker arm according to claim 1, wherein:

said through hole has a stepped shape narrowing toward said lubricant discharging nozzle and having at least one step;

said lubricant discharging nozzle includes a shape configured to fit in said stepped shape of said through hole, and is capable of elastically deforming to a size so as to be capable of passing through a portion having a smallest inner diameter of said stepped shape; and said lubricant discharging nozzle includes a hole that is in communication with said through hole.

5. The rocker arm according to claim 1, wherein said lubricant discharging nozzle includes a flange portion for positioning a direction of said lubricant discharging nozzle with respect to said rocker arm body.

6. The rocker arm according to claim 5, wherein said flange portion has a shape that matches with a predetermined location of an outer contour of said rocker arm body.

* * * * *